US008465122B2

(12) United States Patent
Kato

(10) Patent No.: US 8,465,122 B2
(45) Date of Patent: Jun. 18, 2013

(54) LIQUID JETTING APPARATUS

(75) Inventor: Yoshinori Kato, Nagoya-shi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 266 days.

(21) Appl. No.: 13/075,003

(22) Filed: Mar. 29, 2011

(65) Prior Publication Data

US 2011/0242208 A1 Oct. 6, 2011

(30) Foreign Application Priority Data

Mar. 31, 2010 (JP) ..... 2010-081635

(51) Int. Cl.
*B41J 2/165* (2006.01)

(52) U.S. Cl.
USPC ..... 347/33

(58) Field of Classification Search
None
See application file for complete search history.

(56) References Cited

FOREIGN PATENT DOCUMENTS

| | | | |
|---|---|---|---|
| JP | H06-344572 | A | 12/1994 |
| JP | H11-170552 | A | 6/1999 |
| JP | 2000-103069 | A | 4/2000 |
| JP | 2001-171137 | A | 6/2001 |
| JP | 2001-287376 | A | 10/2001 |
| JP | 2007-176008 | A | 7/2007 |
| JP | 2010-052336 | A | 3/2010 |
| JP | 2010-058392 | A | 3/2010 |

OTHER PUBLICATIONS

Partial translation of JP 2010-052336 A. JP 2010-052336 A was published on Mar. 11, 2010.*

Japan Patent Office, Notice of Reasons for Rejection for Japanese Patent Application No. 2010-081635 (counterpart Japanese patent application), mailed Aug. 21, 2012.

* cited by examiner

*Primary Examiner* — Matthew Luu
*Assistant Examiner* — Justin Seo
(74) *Attorney, Agent, or Firm* — Baker Botts L.L.P.

(57) ABSTRACT

A liquid jetting apparatus includes: a liquid jetting head which has a liquid jetting surface being formed with a nozzle to jet a liquid to a recording medium; a wiper which makes contact with the liquid jetting surface to bend and wipes away the liquid adhered to the liquid jetting surface; a movement mechanism which moves the wiper relative to the liquid jetting surface in a wipe direction along the liquid jetting surface; a movement controller which stops the wiper, which has wiped away the liquid adhered to the liquid jetting surface by moving relative to the liquid jetting surface in the wipe direction, at a predetermined stop position; and a separating mechanism which separates the wiper stopped by the movement controller from the liquid jetting surface in a separating direction intersecting the liquid jetting surface.

7 Claims, 8 Drawing Sheets

60
61
62
63
64
65
65a
A
SCANNING DIRECTION
TRANSPORT DIRECTION

LIQUID JETTING APPARATUS

CROSS REFERENCE TO RELATED APPLICATION

The present application claims priority from Japanese Patent Application No. 2010-081635, filed on Mar. 31, 2010, the disclosure of which is incorporated herein by reference in its entirety.

BACKGROUND OF THE INVENTION

1. Field of the Invention

The present invention relates to liquid jetting apparatuses which jet liquids.

2. Description of the Related Art

Liquid jetting apparatuses such as ink-jet printers jetting ink from nozzles toward a recording medium to record images have been conventionally utilized in various fields. With respect to such liquid jetting apparatuses, there is a known technology to wipe away the liquid adhered to the liquid jetting surface with an elastic wiper. In particular, the liquid adhered to the liquid jetting surface is wiped away by moving the wiper relative to the liquid jetting surface in a state that the end portion of the wiper is bent or flexed by contact with the liquid jetting surface, of the liquid jetting head, in which a plurality of nozzles are formed.

However, if the wiper is further moved to cross the end portion of the liquid jetting head after it has wiped away the liquid adhered to the liquid jetting surface, at the moment of coming off the liquid jetting surface, the wiper bent or flexed by contact with the liquid jetting surface will be recovered in an instant. Then, due to a considerable repulsion force, the liquid adhered to the wiper will be spattered around.

In order to solve the above problem, as a configuration to diminish spattering of the liquid adhered to the wiper, in the liquid jetting apparatus described in Japanese Patent Application Laid-Open No. 06-344572, for example, after wiping the area of the liquid jetting surface in which the nozzles are formed, the wiper is stopped in a state of contact with the liquid jetting surface before moving to cross the end portion of the liquid jetting head. Then, the stopped wiper is moved in a direction perpendicular to the liquid jetting surface, and the flexed wiper is recovered while being separated from the liquid jetting surface.

However, in the liquid jetting apparatus described in Japanese Patent Application Laid-Open No. 06-344572, when the wiper is stopped in a state of contact with the liquid jetting surface, and the flexed wiper is separated from the liquid jetting surface, the wiper may sometimes come off the liquid jetting surface before being completely recovered. At this time, the wiper is recovered from a deformed state to the original state at a stretch, thereby causing the ink adhered to the wiper to spatter around. Especially, a deeply flexed wiper contains a considerable elastic energy. Therefore, when the wiper is recovered, a large repulsion force may be generated to bring in a problem that the liquid adhered to the wiper spatters in a wide range inside of the liquid jetting apparatus body. It is conceivable to separate the wiper from the liquid jetting surface at a slow speed so that the wiper is not recovered vigorously. However, in this manner, it takes a longer time to separate the wiper from the liquid jetting surface.

SUMMARY OF THE INVENTION

Accordingly, an object of the present invention is to provide a liquid jetting apparatus which diminishes spattering of the liquid adhered to the wiper without separating the wiper at a slow speed so that the repulsion force of the wiper is slowly weakened when the wiper completely separates from the liquid jetting surface.

According to an aspect of the present invention, there is provided a liquid jetting apparatus which jets a liquid to a recording medium, including: a liquid jetting head which has a liquid jetting surface, the liquid jetting surface being formed with a nozzle from which the liquid is jetted to the recording medium; a wiper which makes contact with the liquid jetting surface to bend and wipes away the liquid adhered to the liquid jetting surface; a movement mechanism which moves the wiper relative to the liquid jetting surface in a wipe direction along the liquid jetting surface; a movement controller which stops the wiper, which has wiped away the liquid adhered to the liquid jetting surface by being moved relative to the liquid jetting surface in the wipe direction by the movement mechanism while making contact with the liquid jetting surface, at a stop position facing an area on a downstream side of the wipe direction with respect to the nozzle of the liquid jetting surface; and a separating mechanism which separates the wiper having been stopped by the movement controller from the liquid jetting surface in a separating direction intersecting the liquid jetting surface, wherein: at least an end portion, of the wiper, which makes contact with the liquid jetting surface is elastic; a groove in which the end portion of the wiper positioned at the stop position is accommodated is formed in the area on the downstream side of the wipe direction with respect to the nozzle; the groove has a contact surface with which the end portion of the wiper positioned at the stop position makes contact; and the groove is configured such that a bending amount of the wiper when the end portion of the wiper is in contact with the contact surface is smaller than a bending amount of the wiper when the end portion of the wiper is in contact with the liquid jetting surface in another area different from the area in which the groove is formed, and that the wiper is not completely recovered to an original state when the end portion of the wiper is in contact with the contact surface. Further, the "wipe direction" and the "separating direction" in accordance with the present invention refer to the orientation or azimuth of a direction.

According to the liquid jetting apparatus of the present invention, the wiper flexed by contact with the liquid jetting surface is not completely recovered but partially recovered when it stops at the stop position and is accommodated in the groove. As a result, the flexion of the wiper becomes shallow, and thereby the elastic energy becomes low. In this state, even if the wiper comes off the liquid jetting surface before being completely recovered, because the elastic energy in the wiper is lower in comparison with the conventional cases, the repulsion force of the wiper is weak, and thereby it is possible to diminish spattering of the liquid adhered to the wiper. Therefore, it is possible to diminish spattering of the liquid adhered to the wiper without detaching the wiper at a slow speed to keep the repulsion force of the wiper from functioning as the wiper completely comes off the liquid jetting surface.

DESCRIPTION OF THE PREFERRED EMBODIMENT

Figure 1:
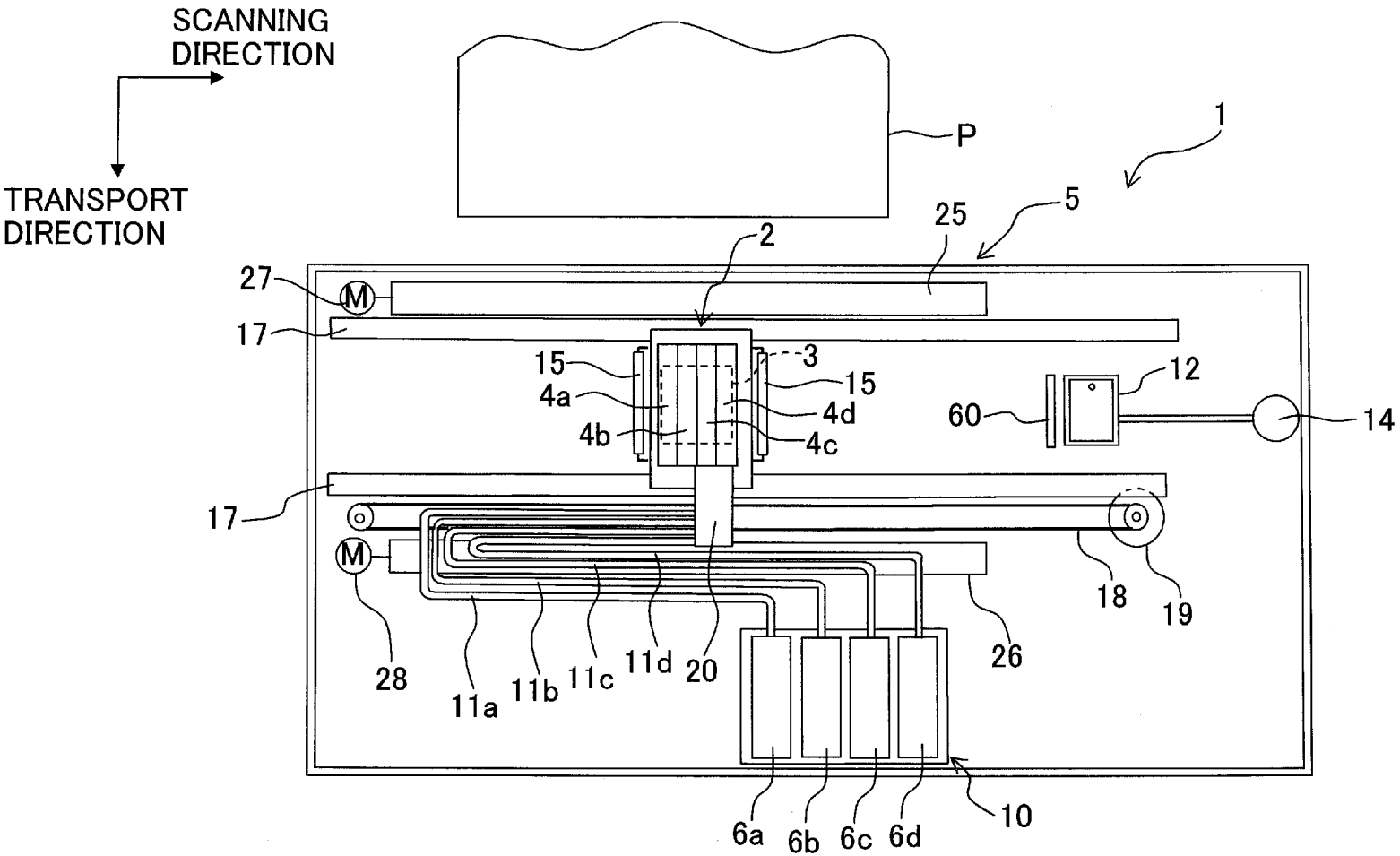
FIG. 1 is a plan view showing a schematic construction of a printer as an example of the liquid jetting apparatus in accordance with an embodiment of the present invention.
Figure 2:
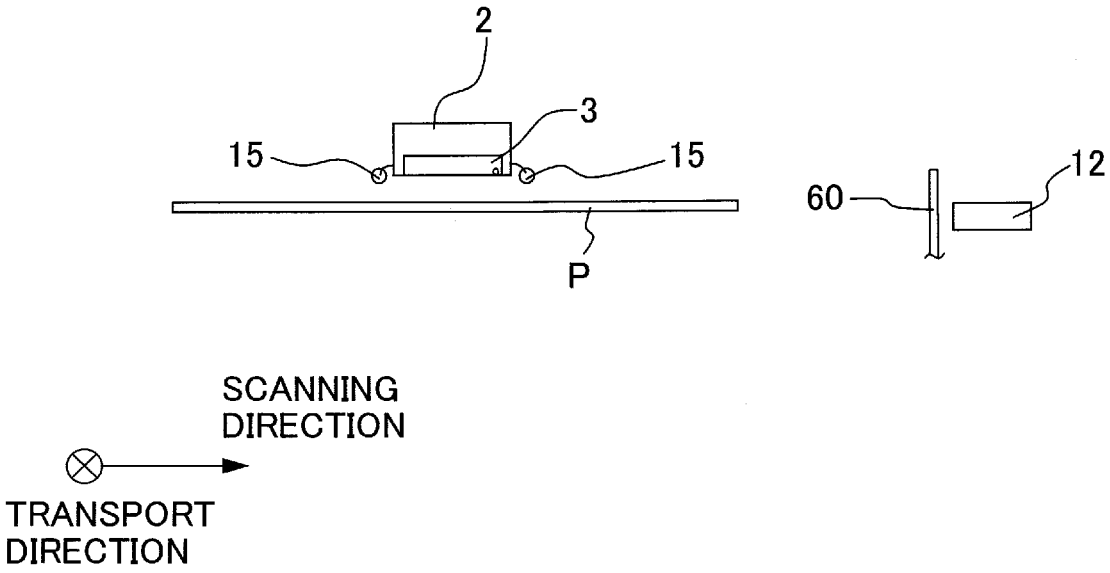
FIG. 2 is a front view around an ink-jet head.

Hereinafter, explanations will be made with respect to a preferred embodiment of the present invention. In the embodiment described below, the present invention is applied to a printer which records desired characters, images, and the like on a recording paper by jetting inks from an ink-jet head to the recording paper.

Hereinbelow, explanations will be made regarding the front side of the sheet of FIG. 1 as the upper side and the back side of the sheet of FIG. 1 as the lower side. A printer 1 (liquid jetting apparatus) includes a carriage 2 (holding member) constructed to be movable in a reciprocating manner along two guide shafts 17 extending to be parallel to a left-right direction (scanning direction) of FIG. 1, an ink-jet head 3 (liquid jetting head) and sub-tanks 4*a* to 4*d* provided on the carriage 2, a transport mechanism 5 for transporting a recording paper P in a transport direction (toward the lower side of the sheet of FIG. 1), ink cartridges 6*a* to 6*d* for storing inks, a suction cap 12 tightly attachable to the lower surface of the ink jet head 3, a wiper 60 capable of wiping the lower surface of the ink-jet head 3 (the surface on the back side of the sheet of FIG. 1), and the like.

Further, the carriage 2 is connected to an endless belt 18 to move in the scanning direction along with the movement of the endless belt 18 when a carriage drive motor 19 drives the endless belt 18 to move.

The ink jet head 3 and the four sub-tanks 4*a* to 4*d* are provided on the carriage 2. The ink jet head 3 jets the inks from a plurality of nozzles 35 provided in its lower surface (see FIG. 3) to the recording paper P transported by the transport mechanism 5 in a downward direction of FIG. 1, while reciprocating together with the carriage 2 in the scanning direction. By virtue of this, desired characters, images, and the like are recorded on the recording paper P.

The four sub-tanks 4*a* to 4*d* are arranged along the scanning direction. Further, a tube joint 20 is provided integrally with these four sub-tanks 4*a* to 4*d*. Then, the four sub-tanks 4*a* to 4*d* are connected respectively to the four ink cartridges 6*a* to 6*d* via flexible tubes 11*a* to 11*d* connected to the tube joint 20.

The transport mechanism 5 has a paper feeding roller 25 which is arranged on the upstream side with respect to the ink-jet head 3 in the transport direction, and a paper discharging roller 26 which is arranged on the downstream side with respect to the ink jet head 3 in the transport direction. The paper feeding roller 25 and the paper discharging roller 26 are driven to rotate by a paper feeding motor 27 and a paper discharging motor 28, respectively. Further, the transport mechanism 5 is constructed to supply the recording paper P from the upper side of FIG. 1 toward the ink jet head 3 by means of the paper feeding roller 25 and, at the same time, to discharge the recording paper P on which characters, images, and the like have been recorded by the ink jet head 3 to the lower side of FIG. 1 by means of the discharging roller 26.

Four-color inks of magenta, cyan, yellow, and black are stored respectively in the four ink cartridges 6*a* to 6*d* which are installed in a holder 10 in a removable manner.

The four-color inks stored in the four ink cartridges 6*a* to 6*d* are supplied to the ink jet head 3 after being temporarily stored in the four sub-tanks 4*a* to 4*d*. That is, the four sub-tanks 4*a* to 4*d*, and the four flexible tubes 11*a* to 11*d* connecting these four sub-tanks 4*a* to 4*d* and the four ink cartridges 6*a* to 6*d* constitute ink supply flow passages to supply the inks to the ink jet head 3.

Figure 3:
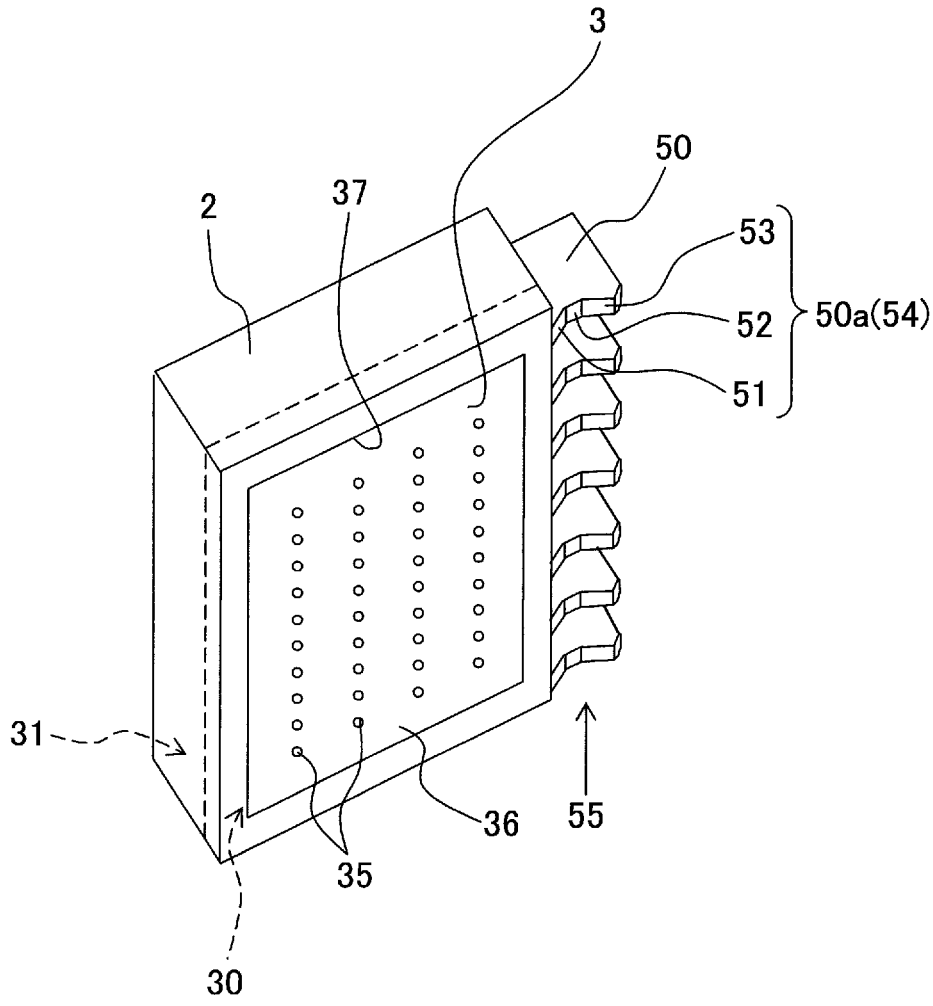
FIG. 3 is a perspective view of the ink jet head.
Figure 4:
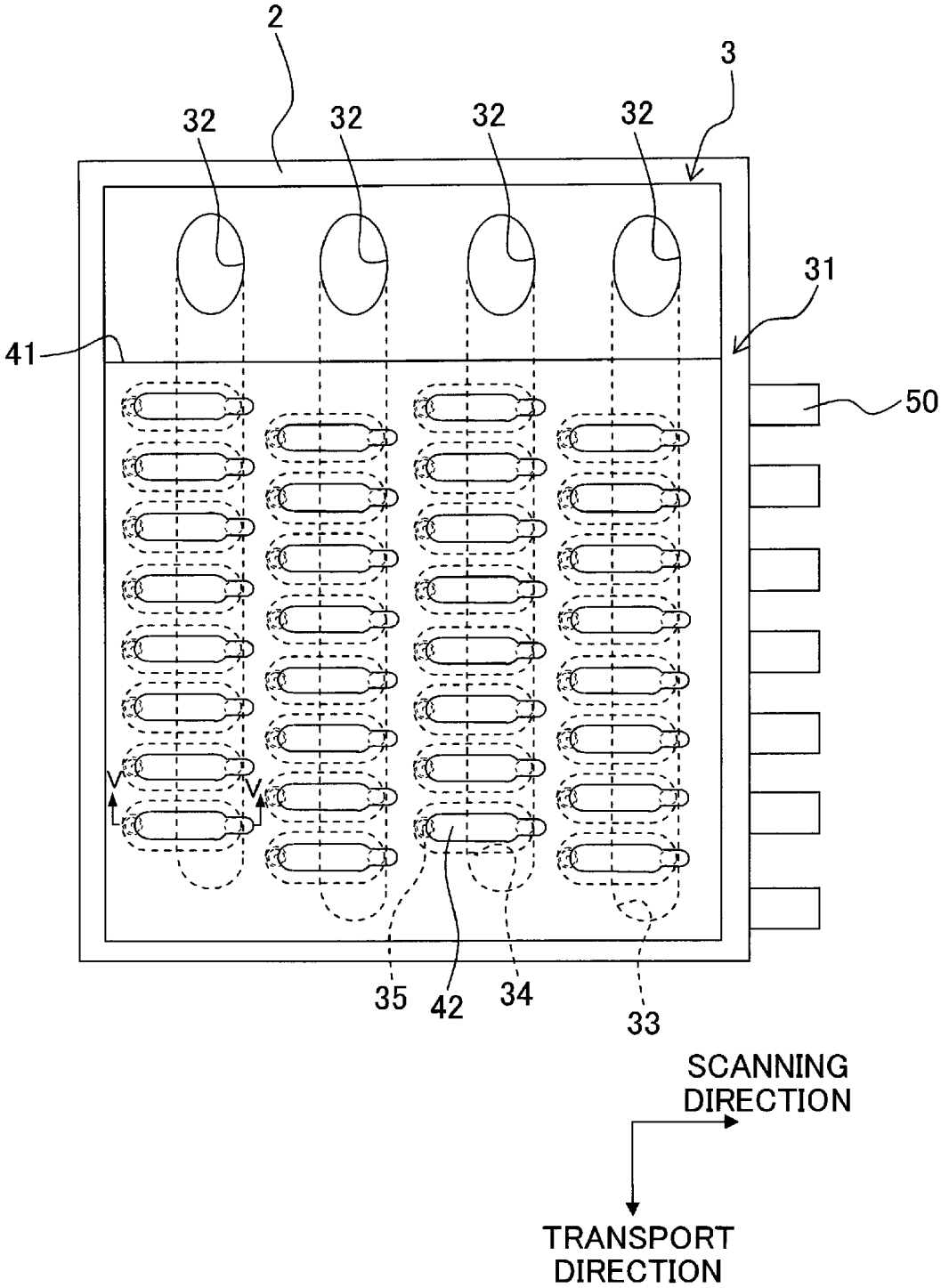
FIG. 4 is a plan view of the ink jet head.
Figure 5:
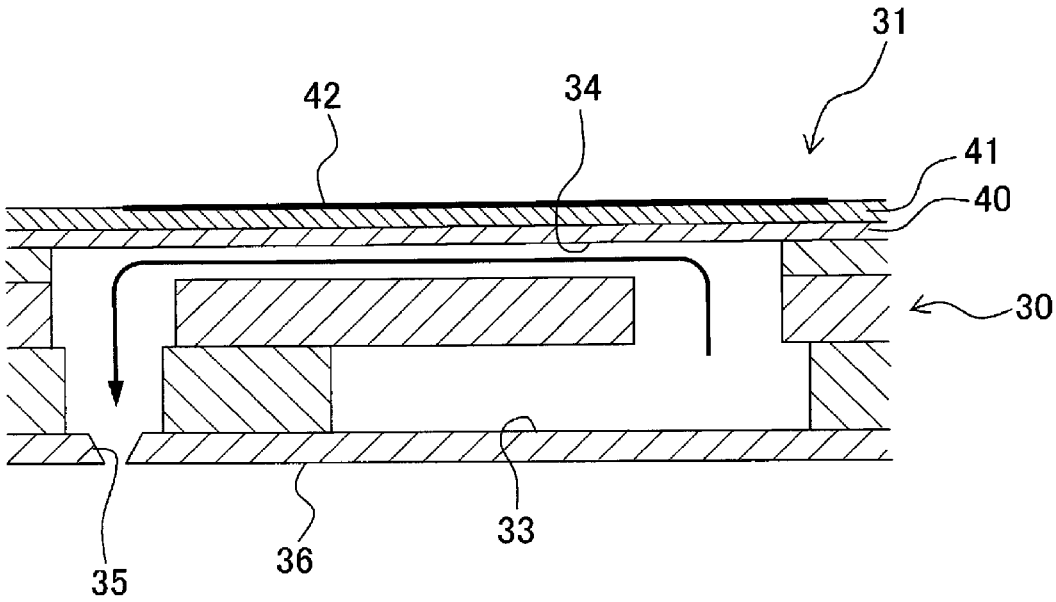
FIG. 5 is a cross-sectional view taken along the line V-V of FIG. 4.

As shown in FIGS. 3 to 5, the ink jet head 3 has a flow passage unit 30 in which ink flow passages are formed, and a piezoelectric actuator unit 31 which applies jetting pressure to the inks inside the ink flow passages. Further, as shown in FIGS. 3 to 5, the carriage 2 has an opening 37 for exposing an ink jetting surface 36, and a plurality of flat plates 50 (plate members) arranged to align on one lateral end portion of the flow passage unit 30 and actuator unit 31 with respect to the scanning direction.

In the flow passage unit 30, there are formed four ink supply ports 32 connected respectively to the four ink cartridges 6*a* to 6*d* via the four flexible tubes 11*a* to 11*d*, four manifolds 33 extending from the ink supply ports 32 respectively along an up-down direction (transport direction) of FIG. 4 perpendicular to the scanning direction, a plurality of pressure chambers 34 in communication with the respective manifolds 33, and the plurality of nozzles 35 which communicate with the plurality of pressure chambers 34, respectively. Then, the lower surface of the flow passage unit 30 is formed as the ink-jetting surface 36 (liquid jetting surface) on which the plurality of nozzles 35 open respectively. The plurality of nozzles 35 and the plurality of pressure chambers 34 are aligned in the transport direction to form nozzle rows and pressure chamber rows and, at the same time, such nozzle rows and pressure chamber rows are aligned in four lines, respectively, in the scanning direction. Then, the inks of magenta, cyan, yellow and black are jetted in the order from the nozzles 35 belonging to the nozzle row on the left side of FIG. 4.

Figure 7:
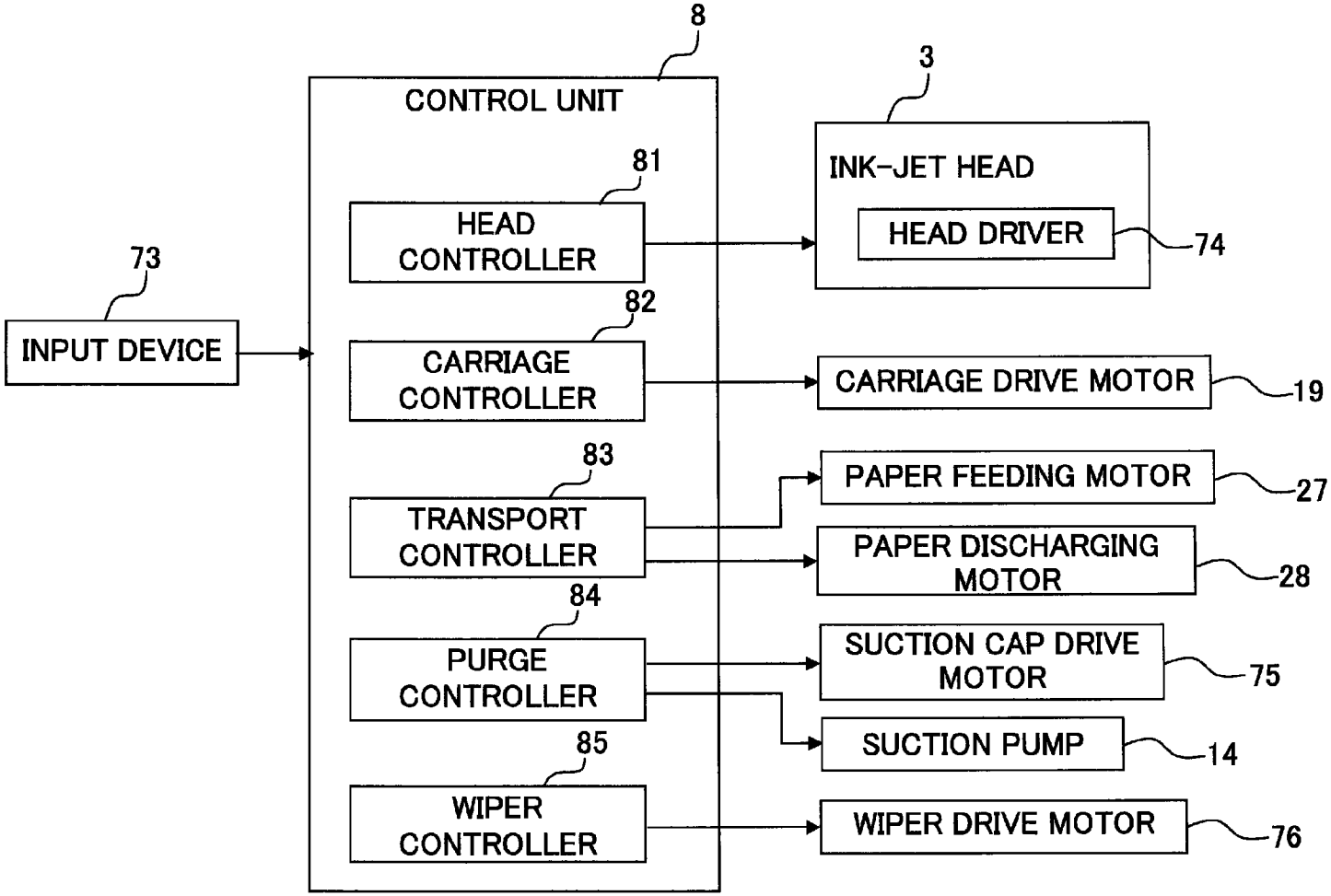
FIG. 7 is a block diagram showing an electrical configuration of the printer.

The actuator unit 31 includes a vibration plate 40 which is joined to the flow passage unit 30 to cover the plurality of pressure chambers 34, a piezoelectric layer 41 which is arranged on the upper surface of the vibration plate 40, and a plurality of individual electrodes 42 which are provided on the upper surface of the piezoelectric layer 41 to correspond to the plurality of pressure chambers 34. Further, when a predetermined drive pulse signal is supplied to an individual electrode 42 from a head driver 74 (see FIG. 7), the actuator unit 31 utilizes a piezoelectric distortion which occurs in the piezoelectric layer 41 to give rise to a flexural deformation in the vibration plate 40. When the flexural deformation occurs in the vibration plate 40, the volume of the pressure chamber 34 is changed. Therefore, a pressure is applied to the ink inside the pressure chamber 34, and thereby ink is jetted from the nozzle 35 in communication with the pressure chamber 34.

The plurality of flat plates 50 are arranged at intervals along the transport direction on the right lateral end portion of the flow passage unit 30 and actuator unit 31 of FIG. 3 with respect to the scanning direction. As shown in FIG. 3, end faces 50*a* of the plurality of flat plates 50 and the ink jetting surface 36 are formed in a spatially continuous manner. In the end face 50*a* of each flat plate 50, there is formed a concave portion 54 (recess) composed of two side surfaces 51 and 53 inclined to the ink-jetting surface 36, and a bottom surface 52 arranged between the two side surfaces 51 and 53 to be parallel to the ink jetting surface 36. Then, the concave portions 54 of the plurality of flat plates 50 are arranged at intervals in the transport direction to form a groove 55 being adjacent to the ink-jetting surface 36 in the scanning direction and extending in the transport direction. Further, the concave portions 54 are arranged away from the surface over which the recording paper P is transported farther than the ink jetting surface 36 of the ink-jet head 3 installed on the carriage 2 in a direction perpendicular to the surface over which the recording paper P is transported.

Referring to FIG. 1 again, on both end portions of the carriage 2 in the scanning direction, cockling rollers 15 are provided respectively to extend in the transport direction. The cockling rollers 15 are driven rollers which project to the lower side beyond the ink jetting surface 36 of the ink jet head 3 and are rotatable by contact with the recording paper P transported by the transport mechanism 5. The recording paper P has a flat surface before printing, that is, before images, characters, and the like are recorded thereon. However, when images, characters, and the like are recorded, it becomes undulant and comes to have an uneven surface because the ink landing amount varies with the ink landing position. As a result, because there is only a very little interspace between the recording paper P transported by the transport mechanism 5 and the ink jetting surface 36 of the ink-jet head 3, if the cockling rollers 15 were not provided, the undulant recording paper P would get in contact with the ink jetting surface 36 to cause possible damage to the nozzles 35 formed in the ink-jetting surface 36. Here, the cockling rollers 15 are provided to press the undulant recording paper P to stretch the same. By virtue of this, the recording paper P is stretched to become flat again and thus prevented from contact with the ink jetting surface 36.

The suction cap 12 is arranged in an area (maintenance area) on the outer side (the right side of FIG. 1) of the print area overlapping the recording paper P transported by the transport mechanism 5 within the travel range of the carriage 2 in the scanning direction, and connected to a suction pump 14. Further, the suction cap 12 is formed of a flexible material such as rubbers, synthetic resins, and the like.

Then, when the carriage 2 (ink-jet head 3) has moved to the maintenance area, the suction cap 12 faces the ink-jetting surface 36 of the ink jet head 3. In this state, the suction cap 12 is driven by a drive mechanism (not shown) to move toward the upper side to be tightly attached to the ink-jetting surface 36 of the ink-jet head 3 to cover the plurality of nozzles 35.

Then, in a state that the suction cap 12 is tightly attached to the ink-jetting surface 36 of the ink jet head 3 to cover the nozzles 35, when the suction pump 14 carries out a suction operation, the air inside the closed space formed with the suction cap 12 and ink-jetting surface 36 is sucked out, and thus the pressure on the inside decreases. Thereby, inks are discharged from the nozzles 35 into the suction cap 12 (liquid purge). By virtue of this, it is possible to discharge thickened inks inside the nozzles 35 and air bubbles mixed into the ink flow passages inside the ink jet head 3 along with the inks from the nozzles 35. Further, this liquid purge is carried out after cartridge replacement and the like at which air bubbles are easily mixed into the ink flow passages inside the ink-jet head 3. Further, when print operations are not carried out, the ink-jet head 3 is located at a home position where the liquid purge is carried out. The ink-jet head 3 moves from this position to the print area to start a print operation.

Figures 6A, 6B, 6C, 6D:
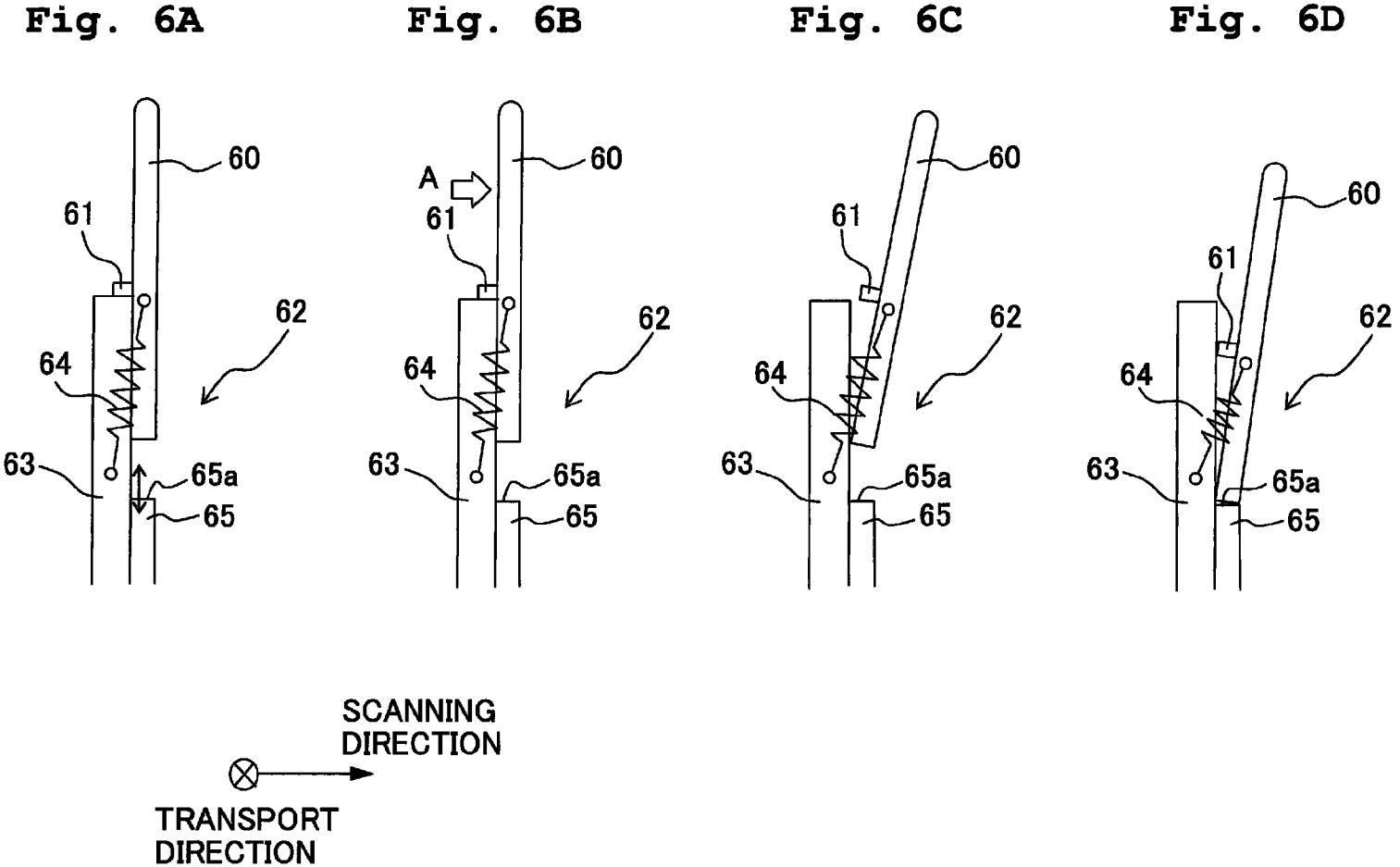
FIGS. 6A to 6D are side views of a wiper.

FIGS. 6A to 6D are side views of a wiper. FIG. 6A shows a posture of the wiper at a wipe position; FIG. 6B shows a posture of the wiper beginning to descend; FIG. 6C shows a posture of the wiper in the midst of descending; and FIG. 6D shows a posture of the wiper at a retreat position. After the liquid purge described hereinabove, when the suction cap 12 separates from the ink jetting surface 36 of the ink-jet head 3, a part of the inks discharged from the nozzles 35 may be adhered to the ink jetting surface 36. Here, from this state, the ink-jet head 3 moves along with the carriage 2 toward the print area. Thereby, the wiper 60 positioned at the wipe position shown in FIG. 6A wipes away the inks adhered to the ink jetting surface 36.

As shown in FIG. 1, the wiper 60 is arranged in the maintenance area to be adjacent to the suction cap 12 on the print area side with respect to the suction cap 12 in the scanning direction. Further, the wiper 60 is formed of an elastic material such as rubbers and the like, and extends to be longer than the nozzle rows in the transport direction. As shown in FIG. 6A, the upper end of the wiper 60 is toward the upper side. Further, by means of a ascending and descending mechanism 62, the wiper 60 is moved in an up-down direction between the wipe position and the retreat position.

The ascending and descending mechanism 62 has a support plate 63 which is in contact with the lateral surface of the wiper 60 on the print area side to support the wiper 60, a tension spring 64 connecting the wiper 60 with the support plate 63, and a movable plate 65 contactable with the bottom surface (lower end) of the wiper 60.

The support plate 63 has the same width as that of the wiper 60 in the transport direction, and is fixed to the printer 1 to be in contact with approximately a lower half of the lateral surface of the wiper 60 on the print area side. The tension spring 64 connects the wiper 60 with the support plate 63 on two end portions of the wiper 60 and the support plate 63 in the transport direction, and one end is connected to the approximate center of the wiper 60 while the other end is connected to the support plate 63 to be at a lower position than the one end. As shown in FIG. 6A, when the wiper 60 is located at the wipe position, the tension spring 64 biases the wiper 60 to the support plate 63 in a left lower direction of FIG. 6A. The movable plate 65 is configured to be movable in the up-down direction by means of a wiper drive motor 76, and its upper surface 65*a* is contactable with the lower end of the wiper 60.

When the movable plate 65 is driven to move upward in a state that the upper surface 65*a* of the movable plate 65 is in contact with the lower end of the wiper 60, the wiper 60 at the retreat position shown in FIG. 6D is pushed up while resisting the biasing force of the tension spring 64. By virtue of this, as shown in FIG. 6A, a convex portion 61 of the wiper 60 engages with the upper surface of the support plate 63, and the wiper 60 is engaged with the support plate 63. That is, the convex portion 61, which is formed at the approximate center in the up-down direction on the lateral surface of the wiper 60 on the print area side, engages with the upper surface of the support plate 63 to restrain the wiper 60 from moving downward. Then, after that, before the wipe operation begins, the movable plate 65, which has pushed up the wiper 60, moves to a lower side so that the movable plate 65 is not in contact with the lower end of the wiper 60.

Next, explanations will be made with respect to the movement of the wiper 60 from the wipe position to the retreat position. As shown in FIG. 6B, in a state that the movable plate 65 is driven to move to the lower side and released from contact with the lower end of the wiper 60, when a force is applied to the wiper 60 in a direction from the print area toward the maintenance area (direction A), the wiper 60 inclines in a clockwise direction of FIG. 6B with the lower end in contact with the support plate 63 as the center. Then, as shown in FIG. 6C, when the convex portion 61 of the wiper 60 is released from engagement with the support plate 63, because of the biasing force of the tension spring 64, the wiper 60 slides with the convex portion 61 and the lower end being in contact with the support plate 63 to move down to the retreat position on the lower side at which the lower end is in contact with the movable plate 65 (see FIG. 6D). Further, the wipe operation by the wiper 60 will be described hereinafter.

Next, explanations will be made with respect to a control unit 8 in charge of the overall control of the printer 1. The control unit 8 shown in FIG. 7 may be, for example, such that includes a CPU (Central Processing Unit), a ROM (Read Only Memory) storing various programs, data and the like for controlling the overall operation of the printer 1, a RAM (Random Access Memory) temporarily storing data and the like to be processed by the CPU, etc., and executes the programs stored in the ROM by the CPU to carry out various controls as will be described hereinbelow. Alternatively, it may also be a hardware-based system which combines various circuits including an arithmetic circuit.

The control unit 8 has a head controller 81, a carriage controller 82 (movement controller), a transport controller 83, a purge controller 84, and a wiper controller 85. The head controller 81 controls the head driver 74 of the ink-jet head 3, based on the data inputted from an input device 73 such as a PC and the like, to make the ink-jet head 3 record images, characters and the like on the recording paper P.

The carriage controller 82 controls the carriage drive motor 19 to reciprocate the carriage 2 thereby reciprocating the ink jet head 3 to scan in the scanning direction. The carriage controller 82 also controls the carriage drive motor 19 to stop the carriage 2. The transport controller 83 controls the paper feeding motor 27 and the paper discharging motor 28 of the transporting mechanism 5 to transport the recording paper P in the transport direction by the paper feeding roller 25 and the paper discharging roller 26.

The purge controller 84 controls a suction cap drive motor 75 and the suction pump 14 to carry out the liquid purge described hereinbefore. The wiper controller 85 controls the wiper drive motor 76 to drive the movable plate 65 to move up and down thereby driving the wiper 60 between the wipe position and the retreat position.

Next, explanations will be made with respect to the wipe operation by the wiper 60 on the ink-jetting surface 36 in reference to FIGS. 8A to 8F showing a process flow from the beginning to the end of the wipe operation in the order from FIG. 8A to FIG. 8F. First, the wiper 60 is located at the retreat position, and the purge controller 84 controls the suction cap drive motor 75 and the suction pump 14 to carry out the liquid purge in a state that the suction cap 12 is tightly attached to the ink jetting surface 36 of the ink jet head 3 having moved to the maintenance area. Then, after the suction cap 12 has separated from the ink jetting surface 36 of the ink jet head 3, the wiper 60 carries out the wipe operation on the ink-jetting surface 36.

Figure 8A:
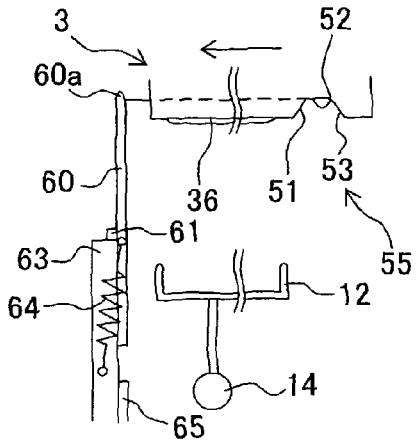
FIGS. 8A to 8F are views for explaining a wipe operation on an ink jetting surface by the wiper.

As shown in FIG. 8A, as the wiper controller 85 drives the movable plate 65 to move upward, the wiper 60 is pushed up to move to the wipe position. At this time, an upper end 60*a* of the wiper 60 is positioned at a position higher than the bottom surface 52 of the groove 55 of the ink-jet head 3. Further, at this time, the convex portion 61 of the wiper 60 engages with the upper end (upper surface) of the support plate 63. Then, if the carriage controller 82 controls the ink-jet head 3 to move along with the carriage 2 toward the print area (the left side of FIG. 8A), then the wiper 60 is regarded as to move relatively to the ink jetting surface 36 in a direction from the left side toward the right side of FIG. 8A (a wipe direction).

Figure 8D:
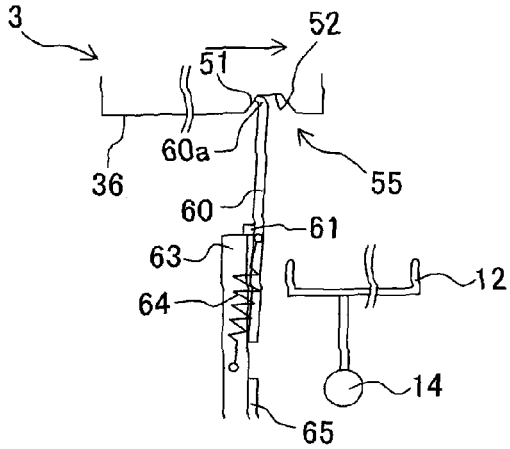
Figure 8B:
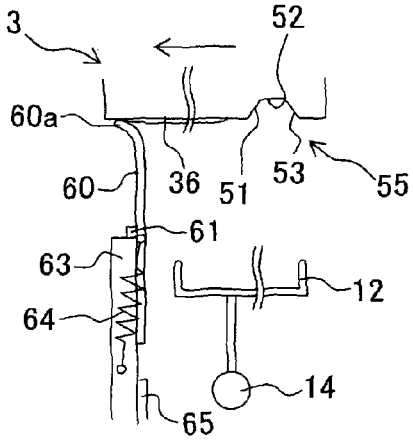

Next, as shown in FIG. 8B, the wiper 60 moves relative to the ink-jetting surface 36 in the wipe direction to come in contact with the end portion of the ink-jet head 3 on the print area side (the left side of FIG. 8B) in the scanning direction. As a result, since the wiper 60 is elastic, the upper end 60*a*, being bent (flexed), comes in contact with the ink-jetting surface 36. As the ink-jet head 3 continues moving further toward the print area (an opposite direction opposite to the wipe direction), the wiper 60 wipes the ink jetting surface 36 in the wipe direction to wipe away the inks adhered to the ink jetting surface 36.

As the ink-jet head 3 continues moving further toward the print area, after wiping the ink-jetting surface 36, the upper end 60*a* of the wiper 60 comes in contact with the side surface 51 of the groove 55 and moves relatively in the wipe direction while being recovered from the flexure little by little.

After that, an encoder (not shown) checks the position of the carriage 2. When the carriage 2 (ink jethead 3) has moved up to the position at which the upper end 60*a* of the wiper 60 is accommodated in the groove 55, the carriage controller 82 stops the ink-jet head 3 from moving toward the print area. That is, when the upper end 60*a* of the wiper 60 is accommodated in the groove 55, the wiper 60 stops moving relative to the ink jetting surface 36. Therefore, in the following explanations, the area spatially continuous with the ink jetting surface 36 to be formed with the groove 55 will be referred to as a stop position of the wiper 60. At this time, the upper end 60*a* of the wiper 60 comes in contact with the bottom surface 52 of the groove 55 (contact surface) formed such that a bending amount of the upper end 60*a* when the upper end 60*a* is in contact with the bottom surface 52 is smaller than a bending amount of the upper end 60*a* when the upper end 60*a* is in contact with the ink-jetting surface 36 and that the wiper 60 is not completely recovered when the upper end 60*a* is in contact with the bottom surface 52 (FIG. 8C). If the groove 55 were not formed, the wiper 60 bent by contact with the ink jetting surface 36 could possibly come off the other end portion of the ink jet head 3. Then, if the bent wiper 60 were recovered instantly, there would be a considerable elastic energy to bring about a considerable repulsion force such that the inks adhered to the wiper 60 might be spattered around. However, in the embodiment, because the upper end 60*a* of the wiper 60 comes into the groove 55, it does not come off the other end portion of the ink-jet head 3 to be recovered but comes in contact with the side surface 53 of the groove 55.

In this manner, because the wiper 60 bent by contact with the ink jetting surface 36 comes into the groove 55 and thus does not come off the other end portion of the ink-jet head 3 to be recovered, it is possible to set the stop position of the wiper 60 in the vicinity of the other end portion of the ink jethead 3. By virtue of this, it is possible to shorten the ink-jetting surface 36 in the wipe direction (the scanning direction), and thus it is possible to miniaturize the ink-jet head 3 in the scanning direction.

Further, when the wiper 60 stops at the stop position, and the upper end 60*a* of the wiper 60 bent by contact with the ink-jetting surface 36 comes into the groove 55, the upper end 60*a* comes in contact with the bottom surface 52, and thereby the wiper 60 is recovered partially but not completely. Therefore, the bending amount of the wiper 60 is decreased, and the elastic energy becomes low. At this time, when the wiper 60 has come into the groove 55 and been recovered a little, for example, even if the inks adhered to the wiper 60 are spattered on the downstream side in the wipe direction, they will get adhered to the side surface 53 of the groove 55. Therefore, it is possible to diminish the inks adhered to the wiper 60 spattering to get adhered to the cockling roller 15 which is provided on the carriage 2 on the downstream side in the wipe direction to be contactable with the recording paper P, etc.

Here, the inks wiped off by the wiper 60 are likely to drip down along the wiper 60. In the embodiment, the plurality of flat plates 50 are arranged at intervals in the transport direction with the concave portions 54 formed to constitute the groove 55 for contact with the upper end of the wiper 60. Therefore, it is possible to suck the inks adhered to the wiper 60 into the intervals of the plurality of flat plates 50 by virtue of the capillary force, and thus it is possible to prevent the inks from dripping down.

After that, as shown in FIG. 8D, in a state that the wiper 60 has come into the groove 55 and stopped at the stop position, the carriage controller 82 moves the ink-jet head 3 in the opposite direction (the direction away from the print area), that is, the wipe direction (from the left side to the right side of FIG. 8D), so as to return the ink-jet head 3 to the home position. As a result, the wiper 60 moves relative to the ink jetting surface 36 in the opposite direction. At this time, the flexed upper end 60*a* of the wiper 60 comes in contact with the side surface 51 of the groove 55 on the upstream side in the wipe direction.

Figure 8E:
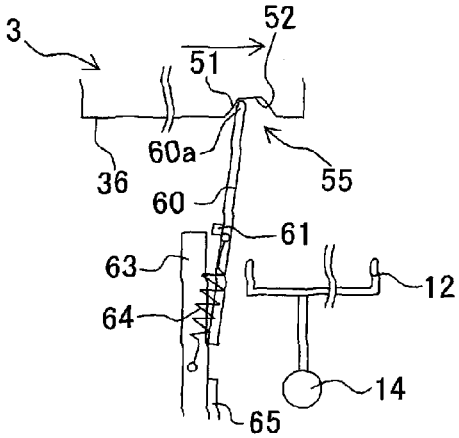
Figure 8C:
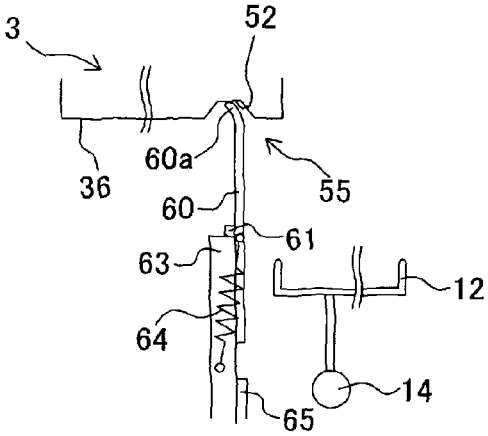
Figure 8F:
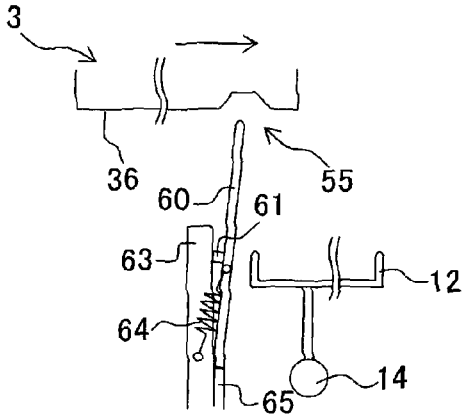

Then, if the ink-jet head 3 continues moving further toward the home position, as shown in FIG. 8E, the wiper 60, being inclined to the ink-jetting surface 36, moves relatively in the opposite direction. Then, the convex portion 61 of the wiper 60 is released from engagement with the support plate 63, and thereby the elastic force of the tension spring 64 causes the wiper 60 to move downward. That is, the wiper 60 moves relatively in the opposite direction and, at the same time, moves toward the retreat position on the lower side. Then, as shown in FIG. 8F, the wiper 60 separates from the ink-jetting surface 36 while being recovered to move to the retreat position, and thus the wipe operation is ended.

In this manner, after coming into the groove 55, the wiper 60 has been partially recovered and lowered its elastic energy. Then, the wiper 60 moves downward (a separating direction) to separate from the ink jetting surface 36 and becomes completely recovered. Therefore, the repulsion force of the wiper 60 becomes weak, and thereby it is possible to diminish spattering of the inks adhered to the wiper 60. Further, the inks adhered to the wiper 60 are sucked into the intervals of the plurality of flat plates 50 forming the groove 55. Thereby, when the wiper 60 comes off the ink jetting surface 36 and becomes completely recovered, the inks adhered to the wiper 60 become little in amount, and thereby it is possible to further diminish spattering of the inks adhered to the wiper 60.

Further, when the wiper 60 which has come into the groove 55 and thus been bent a little, by moving the wiper 60 relative to the ink-jetting surface 36 to the opposite direction opposite to the wipe direction (the upstream side) and, at the same time, separating the wiper 60 from the ink jetting surface 36, the bent wiper 60 separates from the ink jetting surface 36 while being recovered in a state of contact with the bottom surface 52 with the upper end being in contact with the bottom surface 52 of the groove 55 as the supporting point. Thereby, it is possible to further diminish spattering of the inks adhered to wiper 60 when the wiper 60 comes off the ink jetting surface 36 and becomes completely recovered. Further, the wiper 60 is recovered while coming away from the cockling roller 15 provided on the downstream side of the carriage 2 in the wipe direction. Therefore, it is possible to diminish the inks which were spattered while the wiper 60 was becoming recovered to adhere to the cockling roller 15 which may be in contact with the recording paper P.

Further, in the embodiment, it is possible to stop the wiper 60 from moving relative to the ink jet head 3 at the stop position through controlling the movement of the ink jet head 3 by the carriage controller 82 which drives the carriage 2 to move in the print operation. Therefore, it is not necessary to have members such as a movement controller and the like for stopping the wiper 60 at the stop position.

Further, the carriage 2 in accordance with the embodiment corresponds to a movement mechanism in accordance with the present invention; the carriage controller 82 in accordance with the embodiment corresponds to a movement controller in accordance with the present invention; and the ascending and descending mechanism 62 in accordance with the embodiment corresponds to a separating mechanism in accordance with the present invention.

Next, explanations will be made with respect to a few modifications which apply various changes to the embodiment. However, it should be appreciated that the constitutive parts or components, which are the same as or equivalent to those of the embodiment, are designated by the same reference numerals, any explanation of which will be omitted as appropriate.

In the embodiment, the explanations were made with respect to the wipe operation on the ink jetting surface 36 by the wiper 60 after the liquid purge of discharging inks from the nozzles 35. However, the wipe operation may be carried out according to any timing such as at the time of a high possibility that part of the inks discharged from the nozzles 35 may get adhered to the ink jetting surface 36 after the print operation has been carried out a number of times, etc. Further, in such cases, in order to carry out the wipe operation, it is still necessary to move the ink jet head 3 to the maintenance position (area).

Further, in the embodiment, by moving the serial ink jet head 3 in the scanning direction, the wiper 60 is moved relative to the ink-jetting surface 36 in the wipe direction. However, in cases of a line ink jet head and the like, for example, the wiper 60 may be moved in the wipe direction to the ink jetting surface 36 by providing a movement mechanism for moving the wiper 60 in the wipe direction.

Further, in the embodiment, the wiper 60 is moved toward the retreat position on the lower side to be separated from the ink jetting surface 36 while being moved relative to the ink jetting surface 36 in the opposite direction opposite to the wipe direction. However, the wiper 60 may also be moved only toward the retreat position on the lower side to be separated from the ink-jetting surface 36 without being moved relative to the ink-jetting surface 36 in the opposite direction.

Further, the groove 55 may be of any shapes as long as it has a contact surface configured such that the bending amount of the wiper when the wiper is in contact with the contact surface is smaller than the bending amount of the wiper when the wiper is in contact with the ink jetting surface, and that the wiper is not completely recovered when the wiper is in contact with the contact surface.

Further, intervals are formed in the groove 55. However, these intervals may as well not be formed. In this case, instead of the intervals, as a configuration for sucking the inks adhered to the wiper 60, a groove may be formed in a flat surface spatially continuous with the ink jetting surface 36 at an end portion of the ink-jet head 3, or in an area of the ink jetting surface 36 in which the nozzles 35 are not formed, and in the surface of the groove for contact with the upper end 60*a* of the wiper 60, a plurality of holes may be formed to be as large as capable of sucking inks with capillary force.

Further, the elastic portion of the wiper 60 may at least be the portion of the upper end 60*a* which is bent by contact with the ink jetting surface 36.

The embodiment and its modifications described hereinabove are examples of applying the present invention to a printer which jets inks to the recording paper P to record images and the like thereon. The object of applying the present invention is not limited to such a printer. It is possible to apply the present invention to liquid jetting apparatuses utilized in various technical fields.

What is claimed is:

1. A liquid jetting apparatus which jets a liquid to a recording medium, comprising:

a liquid jetting head which has a liquid jetting surface, the liquid jetting surface being formed with a nozzle from which the liquid is jetted to the recording medium;

a wiper which makes contact with the liquid jetting surface to bend and wipes away the liquid adhered to the liquid jetting surface;

a movement mechanism which moves the wiper relative to the liquid jetting surface in a wipe direction along the liquid jetting surface;

a movement controller which stops the wiper, which has wiped away the liquid adhered to the liquid jetting surface by being moved relative to the liquid jetting surface in the wipe direction by the movement mechanism while making contact with the liquid jetting surface, at a stop position facing an area on a downstream side of the wipe direction with respect to the nozzle of the liquid jetting surface; and a separating mechanism which separates the wiper having been stopped by the movement controller from the liquid jetting surface in a separating direction intersecting the liquid jetting surface, wherein: at least an end portion, of the wiper, which makes contact with the liquid jetting surface is elastic;

a groove in which the end portion of the wiper positioned at the stop position is accommodated is formed in the area on the downstream side of the wipe direction with respect to the nozzle;

the groove has a contact surface with which the end portion of the wiper positioned at the stop position makes contact; and the groove is configured such that a bending amount of the wiper when the end portion of the wiper is in contact with the contact surface is smaller than a bending amount of the wiper when the end portion of the wiper is in contact with the liquid jetting surface in another area different from the area in which the groove is formed, and that the wiper is not completely recovered to an original state when the end portion of the wiper is in contact with the contact surface.

2. The liquid jetting apparatus according to claim 1, wherein after the movement controller has stopped the wiper at the stop position, the separating mechanism separates the wiper in the separating direction.

3. The liquid jetting apparatus according to claim 2, wherein a plurality of plate members are arranged at intervals along the liquid jetting surface in a direction intersecting the wipe direction in the area on the downstream side of the wipe direction with respect to the nozzle of the liquid jetting surface; each of the plurality of plate members has a flat surface which is continuous to the liquid jetting surface and a recess which is continuous to the flat surface; and the groove is formed of recesses of the plate members.

4. The liquid jetting apparatus according to claim 3, wherein the movement mechanism reciprocates the liquid jetting head in the wipe direction and an opposite direction opposite to the wipe direction, and the movement mechanism moves the wiper relative to the liquid jetting head in the wipe direction by moving the liquid jetting head in the opposite direction; and the movement controller controls movement of the liquid jetting head by the movement mechanism to stop the liquid jetting head when the wiper is positioned at the stop position.

5. The liquid jetting apparatus according to claim 2, wherein the separating mechanism separates the wiper which is positioned at the stop position and the end portion of which is accommodated in the groove from the liquid jetting surface in the separating direction, while the movement mechanism moves the wiper relative to the liquid jetting surface in an opposite direction opposite to the wipe direction.

6. The liquid jetting apparatus according to claim 4, further comprising a holding member which has an opening and holds the liquid jetting head to expose the liquid jetting surface from the opening, wherein the plurality of plate members are formed integrally with the holding member.

7. The liquid jetting apparatus according to claim 6, wherein the holding member further includes a roller which is provided on a downstream side of the wipe direction with respect to the plate members and which is rotated by contact with the recording medium when the movement mechanism reciprocates the liquid jetting head to jet the liquid to the recording medium.

* * * * *